US006360917B1

(12) United States Patent
Carlhoff et al.

(10) Patent No.: US 6,360,917 B1
(45) Date of Patent: Mar. 26, 2002

(54) DUAL-CHAMBER CANISTER FOR PRODUCING DILUTED READY-TO-USE-SOLUTIONS WITH ANTI-CONFUSION PROTECTION

(75) Inventors: Gerold Carlhoff, Toenisvorst; Thomas Cosler, Hueckeswagen; Horst Pruehs, Duesseldorf; Robert Scheurl, Inzell, all of (DE); Jim Copeland, Apple Valley; Stephan Muench, Minneapolis, both of MN (US)

(73) Assignee: Henkel-Ecolab GmbH & Co. OHG, Dusseldorf (DE)

( * ) Notice: Subject to any disclaimer, the term of this patent is extended or adjusted under 35 U.S.C. 154(b) by 0 days.

(21) Appl. No.: 09/423,990

(22) PCT Filed: May 9, 1998

(86) PCT No.: PCT/EP98/02723

§ 371 Date: Jul. 12, 2000

§ 102(e) Date: Jul. 12, 2000

(87) PCT Pub. No.: WO98/52864

PCT Pub. Date: Nov. 26, 1998

(30) Foreign Application Priority Data

May 17, 1997 (DE) ..... 197 20 955

(51) Int. Cl.[7] ..... B67D 5/56

(52) U.S. Cl. ..... 222/129; 222/136; 222/331; 222/481

(58) Field of Search ..... 222/129, 136, 222/331, 130, 481, 481.5, 482, 181.2, 181.3; 141/330, 346, 350, 363, 365, 366, 391

(56) References Cited

U.S. PATENT DOCUMENTS

| | | | | | |
|---|---|---|---|---|---|
| 664,237 | A | * | 12/1900 | Deming | 222/41 |
| 2,080,602 | A | * | 5/1937 | Chamberlain | 222/481 |
| 3,416,897 | A | * | 12/1968 | Long et al. | 137/268 |
| 3,770,165 | A | * | 11/1973 | Steinman et al. | 222/136 |
| 4,020,865 | A | * | 5/1977 | Moffat et al. | 137/268 |
| 4,030,664 | A | * | 6/1977 | Tisbo et al. | 222/385 |
| 4,429,812 | A | * | 2/1984 | Steiner et al. | 222/181 |
| 4,666,682 | A | * | 5/1987 | Mayer et al. | 222/189 |
| 4,790,454 | A | * | 12/1988 | Clark et al. | 222/136 |
| 5,526,957 | A | * | 6/1996 | Brown et al. | 222/94 |
| 5,542,581 | A | * | 8/1996 | Habora et al. | 222/331 |
| 5,788,125 | A | * | 8/1998 | Steiner et al. | 222/331 |

* cited by examiner

*Primary Examiner*—Kevin Shaver
*Assistant Examiner*—Stephanie L. Willatt
(74) *Attorney, Agent, or Firm*—Andrew D. Sorensen; Ecolab Inc.

(57) ABSTRACT

The invention relates to a canister comprising a first container (concentrate chamber) holding a concentrate, and a second container (solution chamber) holding a ready-to-use solution constituted by mixing a concentrate and a diluting fluid. According to the invention, the two containers of the canister are configured as chambers of the canister, connected to each other by a fluid jet pump, and can be operated from one side. Both the filling device of the concentrate chamber and the dispensing device of the chamber holding the ready-to-use solution are fitted with coded access control devices. The chambers are arranged partially above each other. The concentrate filling device and the fluid jet pump include a suction pipe and mixture outlet arranged in a canister lid.

16 Claims, 3 Drawing Sheets

DUAL-CHAMBER CANISTER FOR PRODUCING DILUTED READY-TO-USE-SOLUTIONS WITH ANTI-CONFUSION PROTECTION

BACKGROUND 1.0 Field of the Invention

This invention relates to a cannister comprising a container, for storing a concentrate and a container for storing a ready-to-use solution of a concentrate and a diluting liquid. The ready-to-use solution is generally a dilute solution.

2.0 Discussion of Related Art

In the institutional cleaning of hard surfaces, it is very often necessary to prepare ready-to-use solutions from concentrates by adding solvents, for example water. These ready-to-use solutions are then poured into receptacles, such as buckets or bottles, and applied by spray heads fitted to the bottles in conjunction with mops/wiping cloths. They may even be further diluted for application.

The ready-to-use solutions are prepared by the user who mixes a certain amount of concentrate with a corresponding amount of the diluent in accordance with the directions for use. In many cases, the ready-to-use solutions prepared in relatively large quantities in a mixing vessel are stored in the mixing vessel or in a separate container and, for use, are transferred to small bottles. The preparation of larger quantities of ready-to-use solution than needed for the particular application derives from the fact that establishing precise concentrations or adhering to mixing instructions is easier with relatively large quantities.

It was precisely with the handling of relatively large quantities in mind that a process in which mixing was simplified and made easier to control by an injector system was also subsequently applied. In this process, a predetermined amount of concentrate was transferred with the diluting solution from an external concentrate container to a storage container for the ready-to-use solution by a liquid jet pump or even a simple water jet pump. The quantity required for the particular application can then be transferred from this storage container to application containers or bottles and applied therefrom. The disadvantage of this arrangement is that at least two large containers are required. For transfer and mixing, these large containers have to be connected by hoses which take up considerable space. This is complicated by the fact that, very often, several different concentrates and ready-to-use solutions have to be stored. There is also particular danger in the risk of confusion attributable to the large number of suction hoses which have to be used to change containers.

SUMMARY OF THE INVENTION

With the problems of the prior art in mind, an object of the present invention is to provide a compact container system for storing and mixing ready-to-use solutions of concentrates and diluents which does not take up much space and which is simple to use without any risk of confusion.

In one embodiment of the invention two containers are designed as compartments of a single cannister, are interconnected by a liquid jet pump, and can be accessed from one side. Both a filler of a concentrate compartment, and a transfer unit for a ready-to-use solution compartment are provided with coded access control systems. As a two-compartment cannister, this configuration avoids the previous disadvantages of the prior art because only one cannister need be used for one ready-to-use solution, and the connection between the compartments is integrated. Any risk of confusion both for the introduction of concentrate and for the transfer of ready-to-use solution is eliminated coded access control systems. The fact that the containers can be operated from one enables the cannister to placed on a stand with the operating side to the front, while permitting the cannister to filled or refilled with concentrate. The diluting solution can be introduced into the can through a connection of the liquid jet pump accessible from that side. The ready-to-use solution can be prepared by mixing concentrate and diluent and ready-to-use solutions can be transferred to an application container.

In one preferred embodiment, the two compartments of the cannister are disposed partly above one another, which provides for a particularly compact arrangement. The mounting of both the concentrate filler and the liquid jet pump with its intake tube and mixture outlet in a single lid of the cannister advantageously enables the filler for the concentrate and the pressure nozzle for the connection of the solvent supply to be arranged in such a way that they do not interfere with each other's functions. The provision of an overflow opening in the compartment for the ready-to-use solution prevents the cannister from being placed in any danger of rupturing if the pump is not switched off in time.

Only one refill bottle—of which the pouring geometry fits into the correspondingly shaped access opening—fits into a funnel-like filler of the concentrate compartment. In addition, the provision of a following valve, which can be opened by a product encoded coded opening mechanism on the concentrate filling bottle, additionally prevents filling from containers which have not been correspondingly coded. As will be illustrated by the following description of an exemplary embodiment, the valve prevents the filler from being used as a funnel for non-controlled liquids in the event of improper use.

To ensure that the ready-to-use solution can only be transferred to the intended bottles, it is of advantage to also protect the transfer opening. For example, its access is covered by a tag formed with an opening into which only one bottle—whose pouring spout has a geometric contour specifically adapted to the product—can be inserted. In this way, it is advantageously possible to ensure that a certain ready-to-use solution is only presented in application containers which have a shape specifically adapted to that solution. This makes it easier, even for untrained personnel, to recognize and distinguish between the contents of the application containers.

Since various concentrates are mixed with the same diluent, for example water, it is of particular advantage to provide an air gap at the liquid jet pump between the pressure nozzle and the mixing compartment in order to prevent soiling of the connection nozzle with the concentrate. If the same pressurized water hose were used for various concentrates, this could otherwise lead to the contamination of other systems or the drinking water supply.

It is also of considerable advantage to design the water jet pump for the addition of concentrate in measured doses, for example by the provision of a corresponding adjustable, nozzle diameter, and taking into account the concentrate viscosity and the required mixing ratio. This enables even the strictest recommended concentration ranges to be adhered to in a simple manner.

BRIEF DESCRIPTION OF THE DRAWINGS

Further advantages besides those mentioned will become apparent from the following description of an embodiment illustrated in the accompanying drawings, in which like items are identified by the same reference designation, wherein:

FIG. 1 is a sectional side elevation of a can according to the invention in the form of a two-compartment can. In this embodiment, the concentrate compartment 1 is disposed at least partly above the compartment 2 for the ready-to-use solution. The fillers 3 and the water jet pump 5 are arranged in the common lid 6. The housing of the water jet pump 5 is disposed with its underneath between the suction hose 9 and the mixture outlet tube or hose 10 on the partition which separates the two compartments 1 and 2. Indicated in the filler 3 is a concentrate filling bottle or refill bottle 15 which is inserted into the filler 3 in such a way that it fits into the coded access barrier 7. This situation will be described in more detail hereinafter with reference to FIG. 3. Shown on the water jet pump 5 is the pressure connection 8 which is bent to the left towards the front of the two-compartment can and to which a commercially available pressurized water hose can be fitted by a quick-locking connector. An overflow 11 is shown at the back of the compartment 2 for the ready-to-use solution. The transfer unit 4 provided with a coded access barrier 12 into which an application bottle 14 can be inserted is shown at the lower front end of the compartment 2 for the ready-to-use solution. The situation of the transfer unit 4 is described in more detail in the following with reference to FIG. 4.

Figure 2:
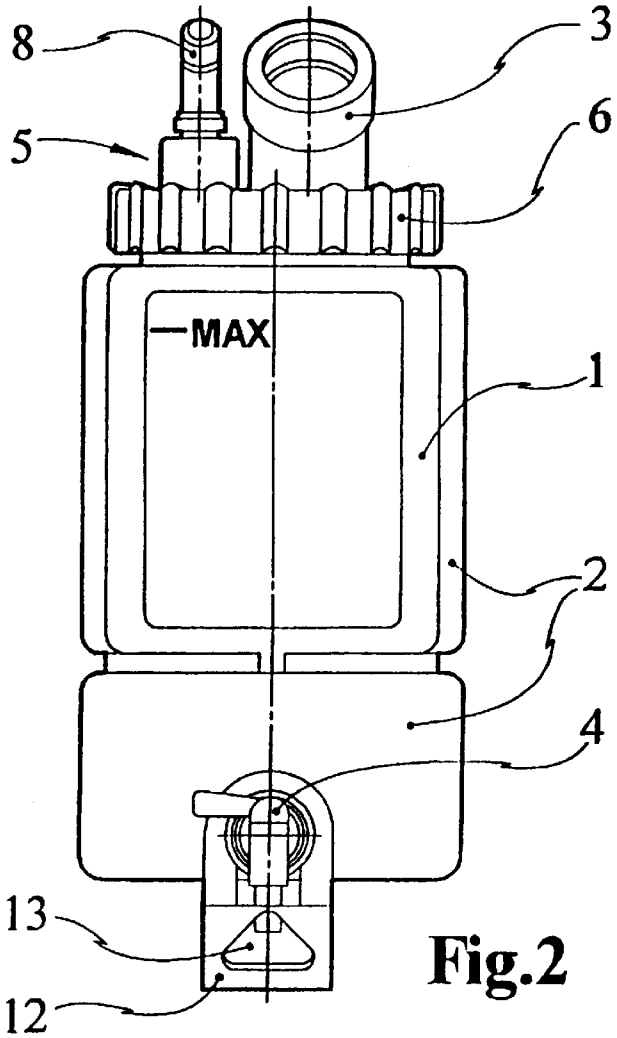
FIG. 2 is a front elevation of the two-compartment cannister shown in FIG. 1.

Shown beneath the coded access barrier 7 of the filler 3 is a valve 20 (see FIGS. 3*a* and 3*c*) which closes the lower access opening 16 to the concentrate compartment 1, and only opens it when it is activated by a product-specifically coded opening system. An opening system such as this may consist, for example, of pins which are arranged on the concentrate filling bottle 15 and which are pushed through corresponding openings 17 (see FIGS. 3*a* and 3*b*). This configuration, will be described in more detail below.

Figure 1:
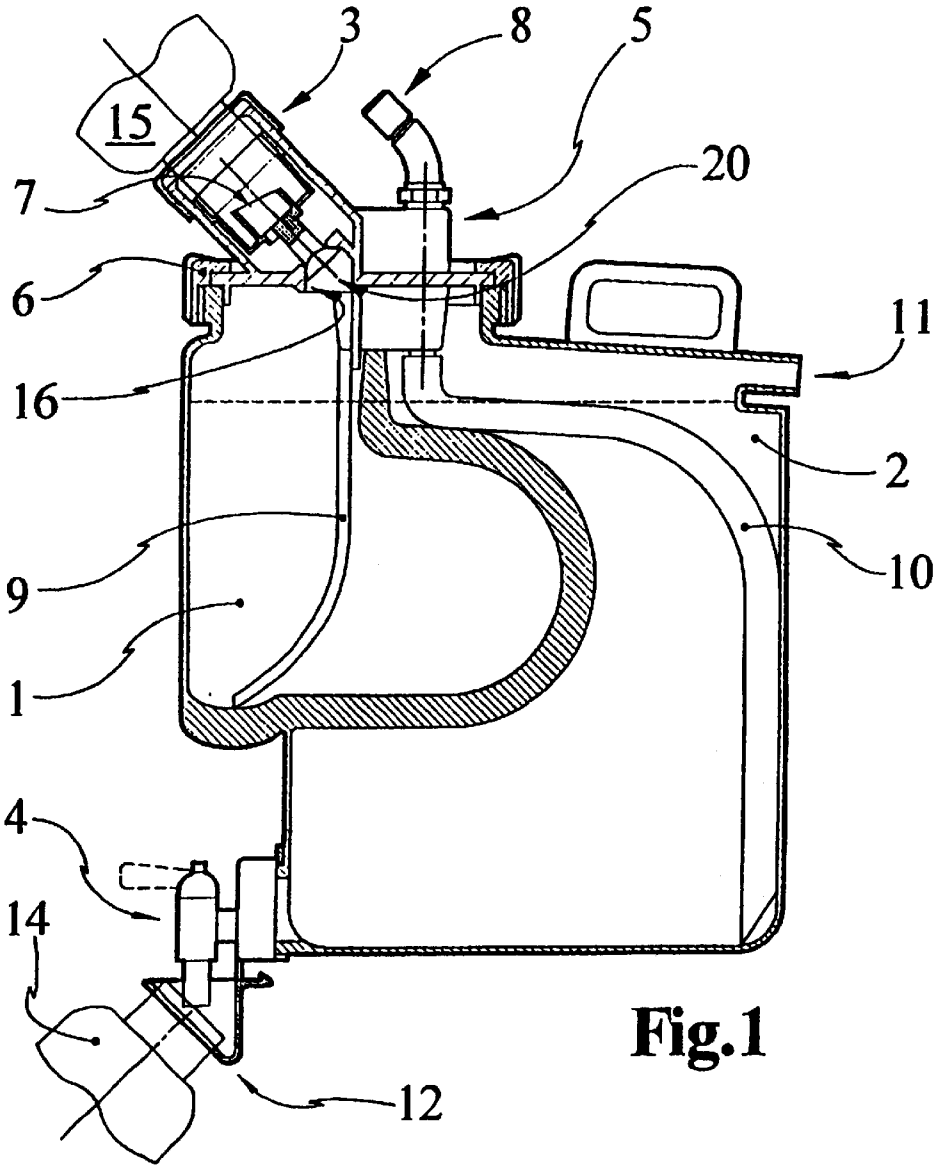
FIG. 1 is a sectional side elevation of a two-compartment cannister.

FIG. 2 is a front elevation of the two-compartment cannister. It can clearly be seen that the concentrate compartment 1 enables the overlying compartment 2 for the ready-to-use solution, which occupies the entire width of the cannister beneath the concentrate compartment 1, to be seen from both sides. Visible above the two-compartment cannister container is the common lid 6 in which the filler 3 and the water jet pump 5 are retained. It can clearly be seen from FIG. 2 that the pressure nozzle 8 of the water jet pump 5 is conveniently accessible and operable from the front. Access to the outlet opening of the transfer unit 4 is blocked by the tag 12. A triangular access opening 13, for example, is arranged in the forwardly inclined tag 12 and can only be engaged by a correspondingly shaped neck of an application container 14 (see FIG. 1).

Figure 3C:
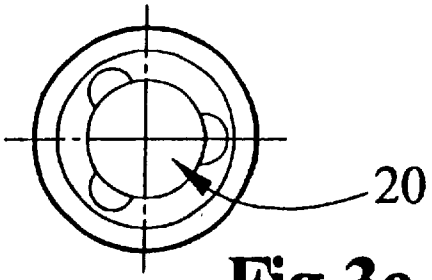
FIG. 3*c* is a bottom plan view of the filler shown in FIG. 3*a*.
Figure 3A:
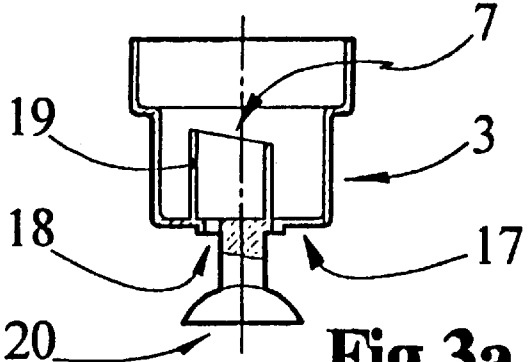
FIG. 3*a* is a sectional side elevation of a coded filler.
Figure 3B:
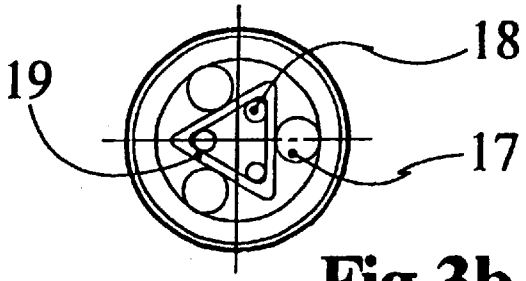
FIG. 3*b* is top plan view of the filler shown in FIG. 3*a*.

The filler 3 is shown in detail in FIGS. 3*a*, 3*b*, and 3*c*. It can be seen from FIG. 3*a* that the filler 3 is in the form of a stepped cylindrical funnel with a column 19 centrally arranged at its base. The outer contour of the column 19 and the openings 17 and 18 arranged inside and outside its casing in the bottom of the funnel 3 correspond to a product-specific code. Only concentrate bottles 15 (see FIG. 1) with a spout designed to correspond to the product-specific code can fit into the funnel 3 with that code. The exact shape of the column 19 corresponding to the code and the openings 17 and 18 is shown in the top plan view in FIG. 3*b*, and in the bottom plan view of FIG. 3*c*. The upper edge of the casing of the column 19 can be designed as a cutting edge which cuts through a film or a correspondingly shaped closure with which the concentrate bottle 15 can be closed. Cutting takes place automatically when a correspondingly coded bottle is inserted.

When the closure of the concentrate bottle 15 is pierced, the filler 3 is displaced so that the valve 20 is opened, thus releasing the lower filling opening 16. In the illustrated embodiment, the valve 20 is shown as a ball segment which opens under pressure locally applied from above. This can be seen in the illustration in FIG. 3*a*.

After concentrate fluid is put into the first compartment 1, as would be understood by one of skill in the art, a water hose (not shown) is connected to pressure nozzle 8, and water under pressure is run through the jet pump 5. As would be further understood by one of ordinary skill in the art, jet pump 5 through action of the water running through it sucks a measured amount of concentrate from compartment 1 via intake tube 9, to mix with water flowing through pump 5 into the second container 2 via hose 10. After a sufficient amount of ready-to-use solution fills container 2, the water is turned off.

Figure 4B:
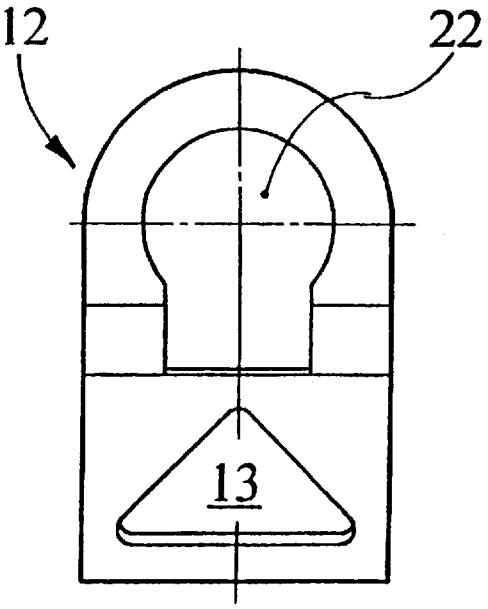
FIG. 4*b* is a front elevation of the access barrier shown in FIG. 4*a*.
Figure 4A:
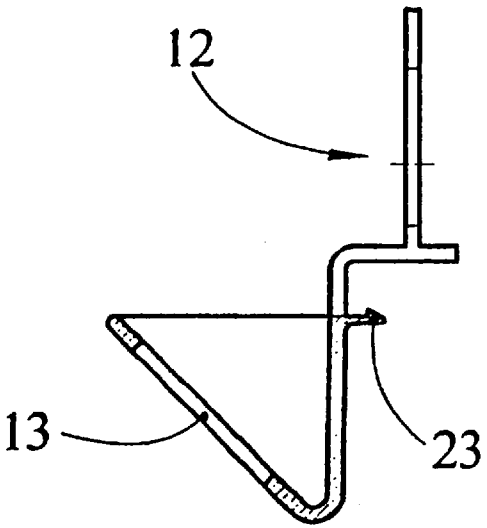
FIG. 4*a* is a sectional side elevation of an access barrier for a transfer unit.

FIGS. 4*a* and 4*b* show the access barrier for opening the transfer unit 4 which, in this case, consists of a tag 12 including a coded access opening 13 inclined at an angle of 45°. In much the same way as described above for filling the concentrate bottle, the ready-to-use solution can only be introduced into application bottles 14 having necks contoured to fit the corresponding code, i.e. in the present case a triangular contour corresponding to the dimensions of the opening 13.

FIG. 4*a* shows a hook-like projection 23 which is suitable for fixing the cannister a correspondingly shaped part of a stand so that the system is additionally stabilized in the standing position. Also, a tag 12 in the form illustrated can readily be placed over the neck of the transfer unit 4 without any need to provide special fastenings.

Figure 5C:
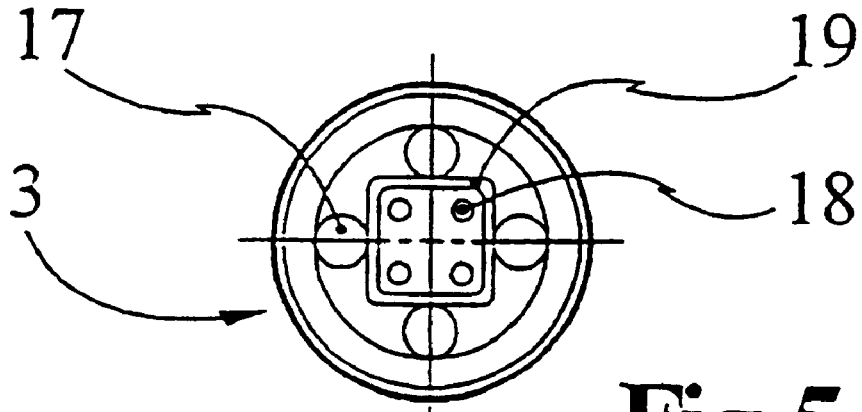
FIGS. 5*a, b* and *c* shows three embodiments of coding geometries respectively.
Figure 5B:
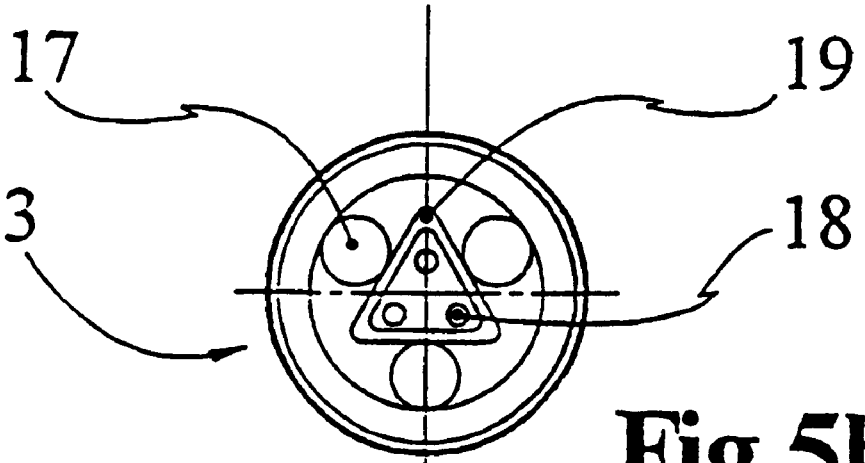
Figure 5A:
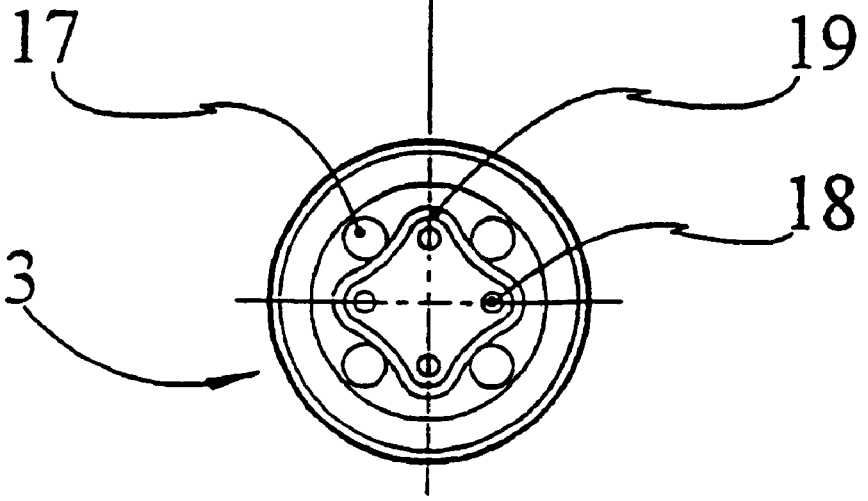

FIGS. 5*a*, 5*b*, and 5*c* show various embodiments of access codes each having the central column 19 inside which the filling openings 17,18 are arranged in the bottom of the funnel 3. In this schematic illustration, of which the portion shown in FIG. 5*b* largely corresponds to the embodiment illustrated in FIGS. 3*a*, 3*b*, and 3*c*. The neck of the concentrate bottle 15 must have a corresponding geometric form to fit onto the column 19 in such a way that the concentrate enters the interior of the column 19 in order to flow through the filling opening 18 into the antecompartment preceding the valve 20 and the lower access opening 16.

What is claimed is:

1. A canister comprising a first compartment for storing a concentrate, and a second compartment for storing a ready-to-use solution of a concentrate and a diluting liquid, wherein the first and second compartments are designed as compartments of a common housing, are interconnected by a liquid jet pump operable for transferring said concentrate from said first compartment to said second compartment, and can be accessed from one side, with both a filler of the concentrate first compartment, and a transfer unit for the ready-to-use solution second compartment each being provided with coded access control systems.

2. A cannister as claimed in claim 1, wherein the compartments are disposed partly above one another.

3. A canister as claimed in claim 1, further including the concentrate filler and the liquid jet pump with an intake tube, and mixture outlet, respectively arranged in a lid of the canister, and the compartment for the ready-to-use solution has an overflow opening.

4. A cannister as claimed in claim 1, wherein the filler of the concentrate compartment is funnel-shaped with a product-specific access geometry, and includes a following valve, the valve being operable by a product-specifically coded opening mechanism on a concentrate filling bottle.

5. A cannister as claimed in claim 1, wherein the liquid jet pump includes an air gap between a pressure nozzle and the second compartment for permitting the addition of concentrate in measured doses.

6. A canister as claimed in claim 1, wherein said coded access control systems include a tag covering an opening of the transfer unit of the second compartment, said tag being formed with an access opening configured to receive a product-specific contour of a ready-to-use solution bottle.

7. A cannister as claimed in claim 2, further including the concentrate filler and the liquid jet pump with an intake tube, and mixture outlet, respectively arranged in a lid of the can and the compartment for the ready-to-use solution has an overflow opening.

8. A cannister as claimed in claim 2, wherein the filler of the concentrate compartment is funnel-shaped with a product-specific access geometry, and includes a following valve, the valve being operable by a product-specifically coded opening mechanism on a concentrate filling bottle.

9. A cannister as claimed in claim 3, wherein the filler of the concentrate compartment is funnel-shaped with a product-specific access geometry, and includes a following valve, the valve being operable by a product-specifically coded opening mechanism on a concentrate filling bottle.

10. A cannister as claimed in claim 2, wherein the liquid jet pump includes an air gap between a pressure nozzle and the second compartment for permitting the addition of concentrate in measured doses.

11. A cannister as claimed in claim 3, wherein the liquid jet pump includes an air gap between a pressure nozzle and the second compartment for permitting the addition of concentrate in measured doses.

12. A cannister as claimed in claim 4, wherein the liquid jet pump includes an air gap between a pressure nozzle and the second compartment for permitting the addition of concentrate in measured doses.

13. A canister as claimed in claim 2, wherein said coded access control systems include a tag covering an opening of the transfer unit of the second compartment, said tag being formed with an access opening configured to receive a product-specific geometric contour of a ready-to-use solution bottle.

14. A canister as claimed in claim 3, wherein said coded access control systems include a tag covering an opening of the transfer unit of the second compartment, said tag being formed with an access opening configured to receive a product-specific geometric contour of a ready-to-use solution bottle.

15. A canister as claimed in claim 4, wherein said coded access control systems include a tag covering an opening of the transfer unit of the second compartment, said tag being formed with an access opening configured to receive a product-specific geometric contour of a ready-to-use solution bottle.

16. A canister as claimed in claim 5, wherein said coded access control systems include a tag covering an opening of the transfer unit of the second compartment, said tag being formed with an access opening configured to receive a product-specific geometric contour of a ready-to-use solution bottle.

* * * * *